US005829073A

United States Patent [19]

Lee

[11] Patent Number: 5,829,073

[45] Date of Patent: Nov. 3, 1998

[54] TOILET TRAINING KIT

[76] Inventor: Jonathan D. Lee, 8411 Kay Ct., Annandale, Va. 22003

[21] Appl. No.: 783,486

[22] Filed: Jan. 14, 1997

[51] Int. Cl.[6] ..... A47K 13/14

[52] U.S. Cl. ..... 4/661; 4/242.1; 4/902; 446/901

[58] Field of Search ..... 4/661, 242.1, 902; 446/901; 434/81, 236, 238, 365, 427–429

[56] References Cited

U.S. PATENT DOCUMENTS

| | | | |
|---|---|---|---|
| 2,293,887 | 8/1942 | Chamberlain | 446/901 |
| 2,586,017 | 2/1952 | Freedman | 446/901 |
| 2,674,813 | 4/1954 | Hutchinson . | |
| 3,118,149 | 1/1964 | Tomasetti | 4/242.1 |
| 3,274,705 | 9/1966 | Friend | 446/901 |
| 4,407,024 | 10/1983 | Schneider . | |
| 4,710,979 | 12/1987 | Bull et al. . | |
| 4,744,113 | 5/1988 | Kogut . | |
| 5,123,130 | 6/1992 | Sanders | 4/902 |
| 5,203,847 | 4/1993 | Butt . | |
| 5,233,845 | 8/1993 | D'Andrade | 446/901 |
| 5,269,691 | 12/1993 | Waldman | 434/428 |
| 5,282,631 | 2/1994 | Baker | 446/901 |
| 5,285,540 | 2/1994 | Putz . | |
| 5,372,509 | 12/1994 | Brocato et al. . | |
| 5,441,262 | 8/1995 | Figone et al. . | |
| 5,636,389 | 6/1997 | LaLonde | 4/242.1 |

*Primary Examiner*—Charles R. Eloshway
*Attorney, Agent, or Firm*—Saidman DesignLaw Group

[57] ABSTRACT

A toilet training system in which a decal having a background scene imprinted thereon is adhesively fixed to a toilet lid and a plurality of appliques, each of which depict an entity belonging to the aforementioned background scene, are provided as individual rewards for a successful potty experience. The child attaches the appliques to the decal to build up a scene.

11 Claims, 8 Drawing Sheets

TOILET TRAINING KIT

BACKGROUND OF THE INVENTION

1. Field of The Invention

This invention relates to a system for toilet training or potty training a child comprising a method for carrying out the training and a toilet training kit for implementing the method.

2. Description of Related Art

It is said that many motivational techniques involve the use of either the carrot or the stick. The reference is to the task of inducing a stubborn mule to pull a wagon. The mule can be encouraged to move forward either by dangling a carrot in front of the mule, near enough to be enticing but always just beyond reach, or by threatening the mule with a stick.

Applying this to the potty training of a child, it seems readily apparent that it is better to use a carrot than a stick. Application of the stick technique, impliedly by associating potty training with a threat of striking a child, or worse, actually striking a child, could leave emotional scars which could last a lifetime, according to the many social psychologists who have warned of the ill effects caused by traumatic potty training. While it is not the subject of this patent to confirm or deny social theories, there is no reason not to make potty training as pleasant as possible, not only for the child but also for the adult. The use of the carrot is much to be preferred.

Implicit in the concept of the carrot is the promise of a reward for good behavior; it would be cruel not to give the carrot to the mule at the completion of the journey, and for our purposes it may be assumed that the mule is suitably rewarded. When desirous of motivating a child to use a toilet instead of soiling his or her diaper, not only must a reward be offered, it must be given to the child after each successful potty experience. All is for naught, however, if the child does not want the reward enough to put forth the desired effort.

Systems for toilet training a child have been the subject of inventive efforts in the past. U.S. Pat. No. 4,744,113 issued to Kogut provides a toilet training aid in the form of a sheet to be attached to the rim of a toilet, the sheet having an invisible picture thereon which is made visible by the child's urine as an attraction and reward for successful pottying. U.S. Pat. No. 5,285,540 issued to Putz provides a training booklet having pictures which are cut out and placed in a potty. The sheets upon which the pictures are imprinted dissolve in urine. The child is said to feel like it is performing magic by making the picture disappear. A chart to record successful events is also provided. While these systems may be attractive to a child, they are deficient in that they are specific only to one aspect of potty training, namely, urinating. They are not effective in teaching the use of the toilet for defecation. Also, they may be too attractive, leading the child to retrieve the pictures after use. It is true children learn best through hands-on experience, but a successful potty training system is one which uses that part of human nature as a positive force rather than a means to disaster.

OBJECTS AND SUMMARY OF THE INVENTION

The present invention overcomes the difficulties described above by providing a toilet training system which is attractive to the child, one which the child will want enough to go through the ardours of potty training. The instant toilet training system comprises the method of affixing a background scene to the top of a toilet lid and of rewarding a child for every successful potty experience with a recognizable entity belonging to the scene in the form of an applique for attachment to the background scene, thereby allowing the child the pleasure of creating a continually growing, changing picture.

The instant toilet training system further comprises a kit for implementing the method, the kit comprising a plurality of appliques, each of which can be individually given sequentially as a reward for each successful potty experience. A sufficient number of appliques are provided to be available throughout the entire potty training period. The system is thus one which will sustain the interest of the child and which is hygienic both for the environment and personally for the child.

The present invention accomplishes the above by providing a kit comprising a decal with a scene printed on one side thereof and with a means for affixing the decal to a toilet lid on the other side, and a plurality of appliques shaped and colored to resemble entities belonging to the scene and sized proportionately for the scene, each applique including means for attaching it to the decal.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
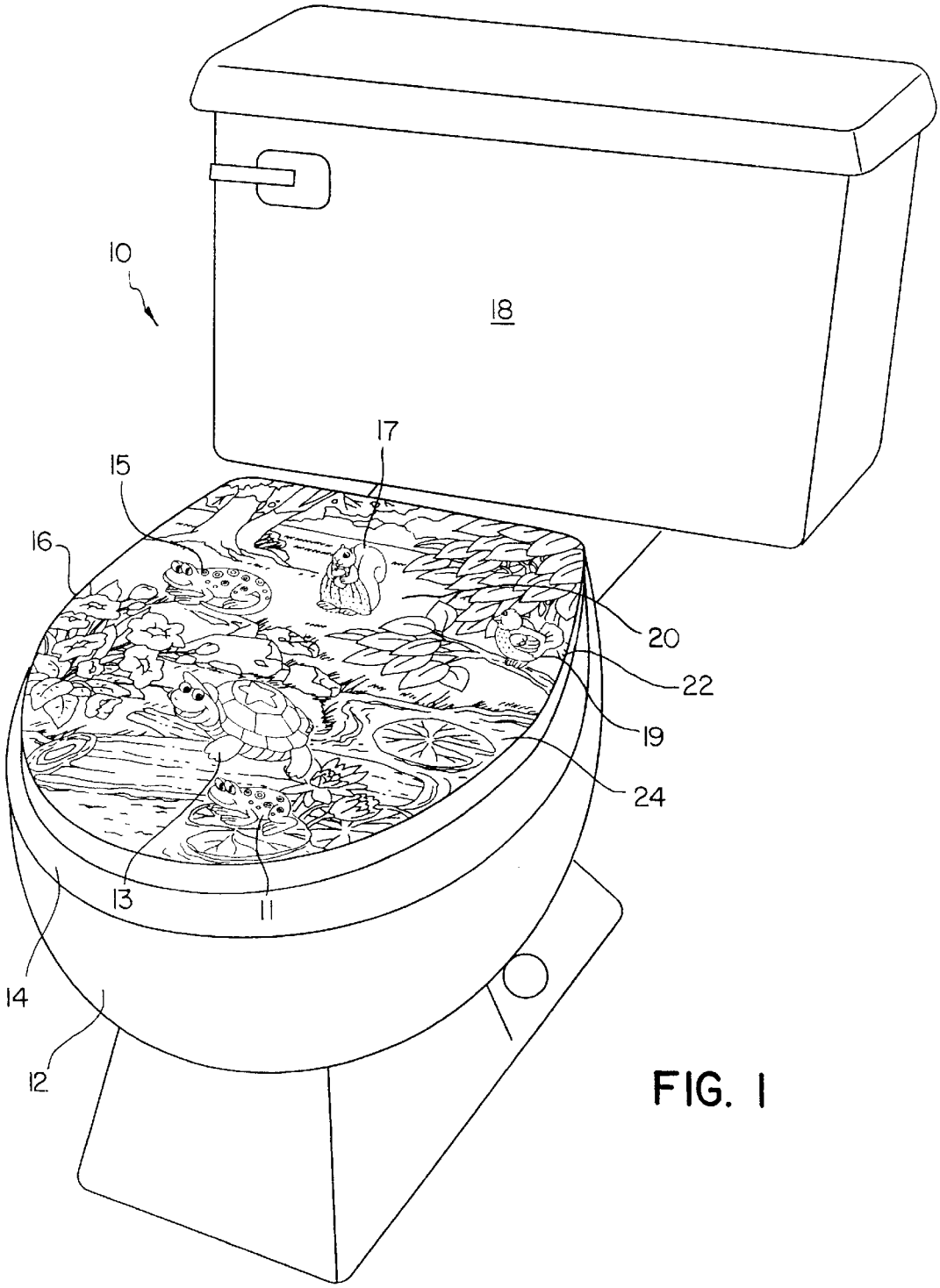
FIG. 1 is a perspective view which illustrates a preferred embodiment of the present invention.

A typical toilet 10 is shown in FIG. 1 comprising a bowl 12, a seat 14, a lid 16, and a water closet 18. A decal 20 is affixed to the top 22 of toilet lid 16 by any convenient means, such as by a releasable adhesive (not shown).

Decal 20 is a flat, planar sheet, preferably of vinyl, having a pastoral scene 24 imprinted on one side and with a pressure-sensitive adhesive on the other side. Decal 20 is intended to cover the major portion of the flat surface of top 22 of lid 16. An oval having major and minor axes of fifteen inches and thirteen and one-half inches has been found to be appropriate. The top surface is preferably very smooth.

Figure 2:
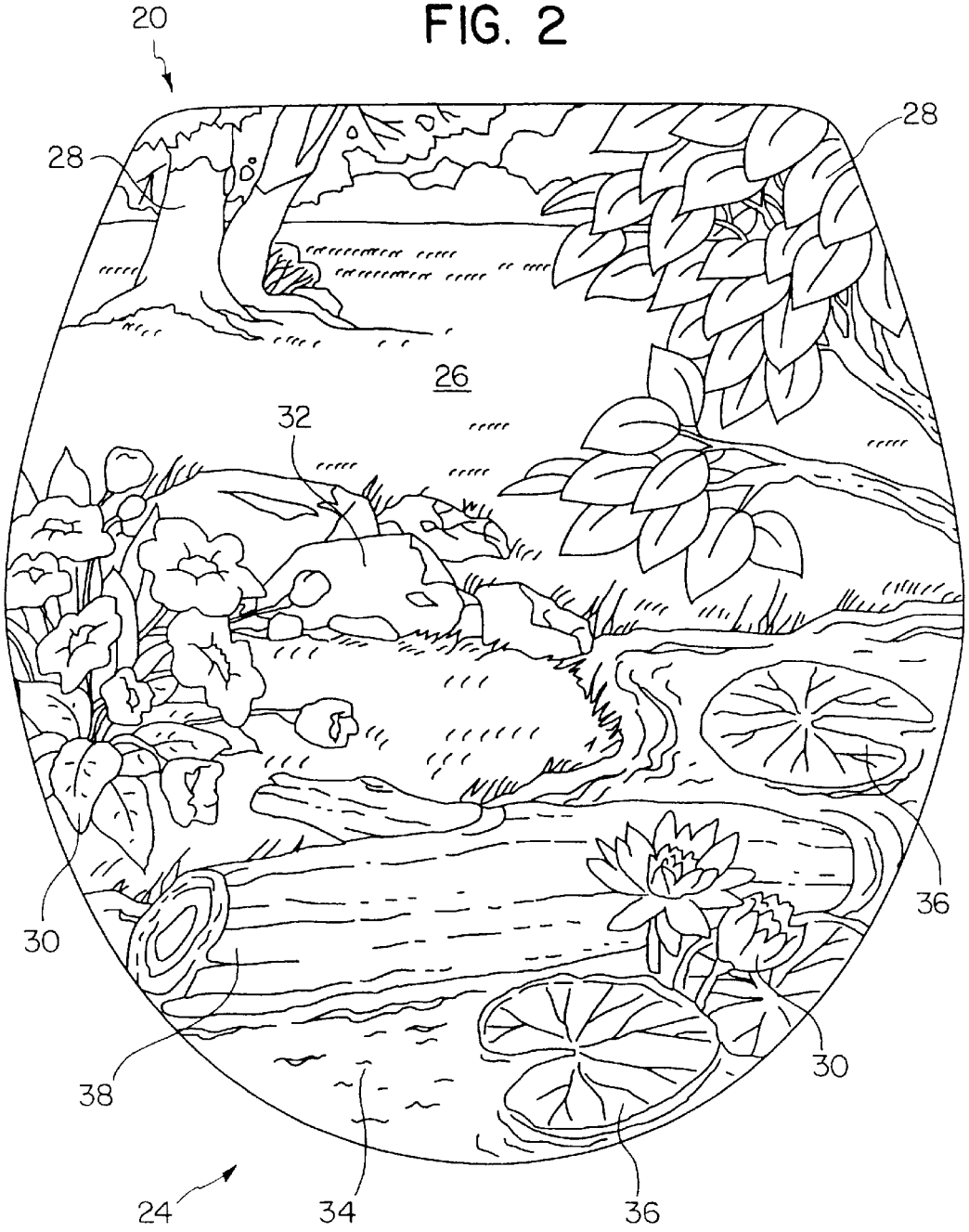
FIG. 2 is a top view of a decal used in the invention.

Pastoral scene 24 is more clearly seen in FIG. 2 and includes a meadow 26, trees 28, flowers 30, rocks 32, a pond or stream 34, lily pads 36, and a log 38. A rural scene has been selected, since it suggests a peaceful environment, which subconsciously relaxes the child, setting the stage for a pleasant, restful potty experience. Preferably, the scene would be depicted as a background, with a minimum of active participants already printed therein. The child can then create whatever activity he or she desires in the scene, thus stimulating the child's imagination.

Scene 24 is also a scene which is attractive to young children. Decal 20 will, of course, be colored appropriately for the scene such that it will excite the interest of the child. It is important that the scene be interesting to the age group to which it is directed, for in order to be effective as a potty training aid, the child must view it as a desirable toy. Any other attractive scene can be imprinted on decal 20, so long as it will motivate the child to want to play with it, and thereby give the child a positive incentive to want to successfully achieve being potty trained. Examples of appliques usable with decal 20 are shown in FIGS. 3–9.

Figure 3:
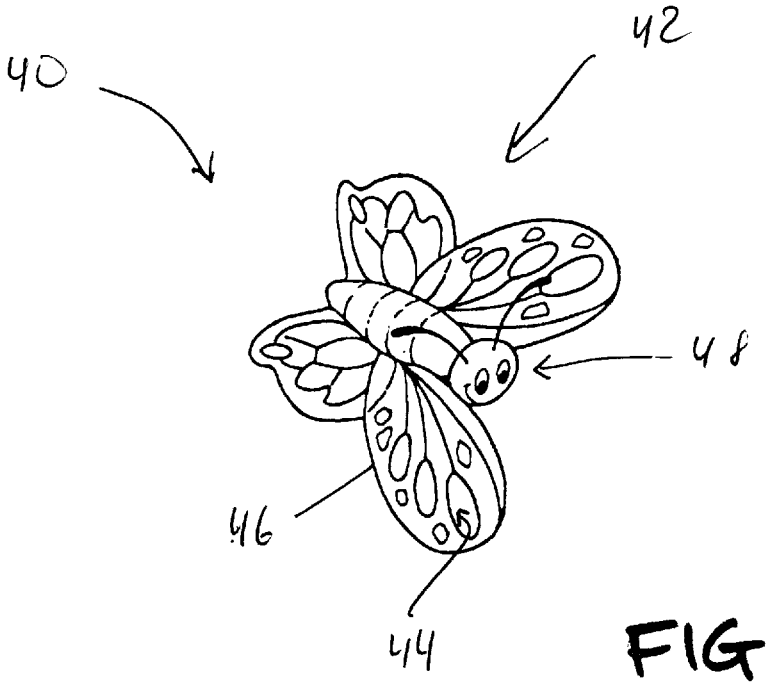
FIGS. 3–9 are top views of various examples of appliques.
Figure 4:
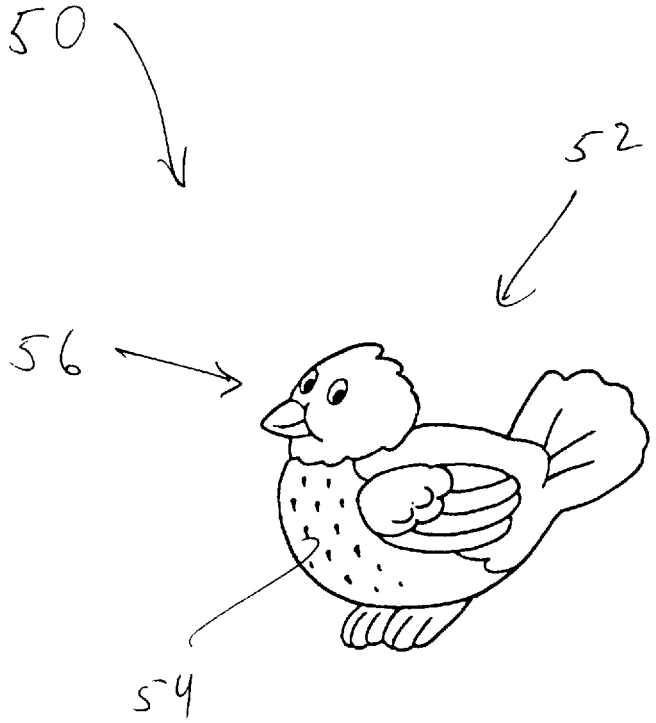
Figure 5:
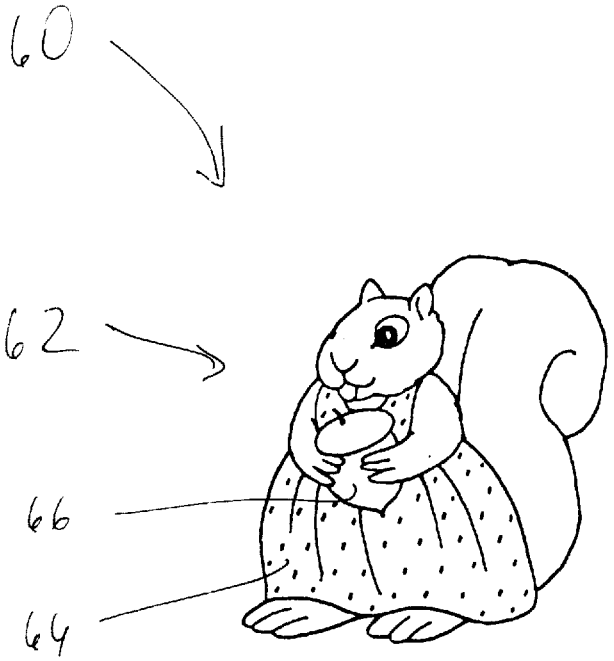
Figure 6:
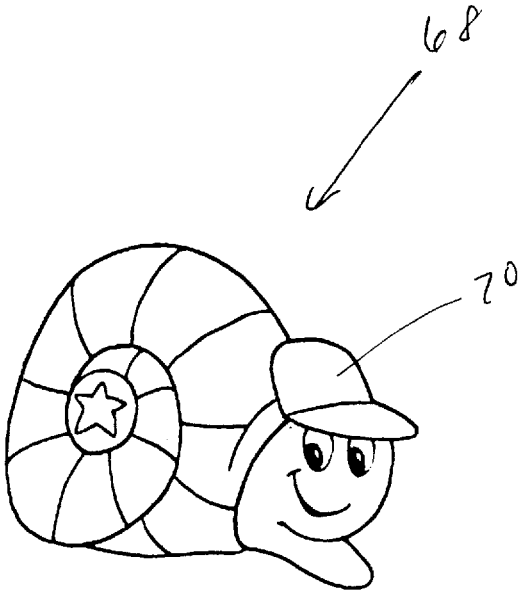
Figure 7:
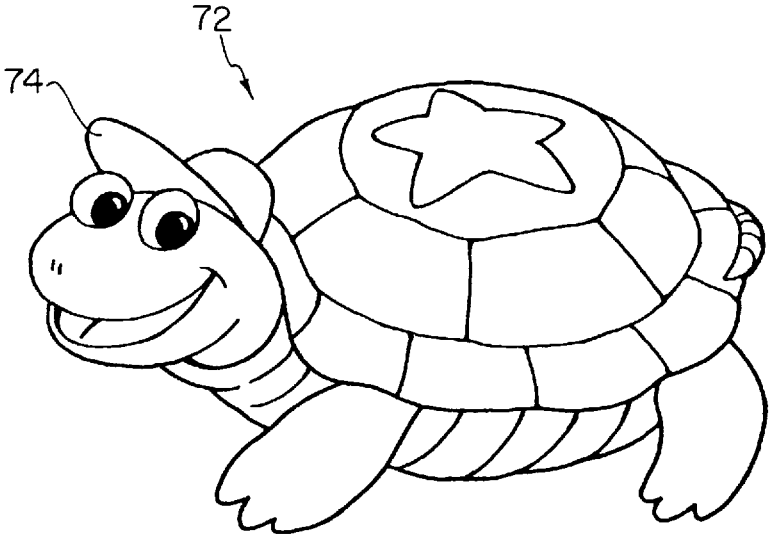
Figure 8:
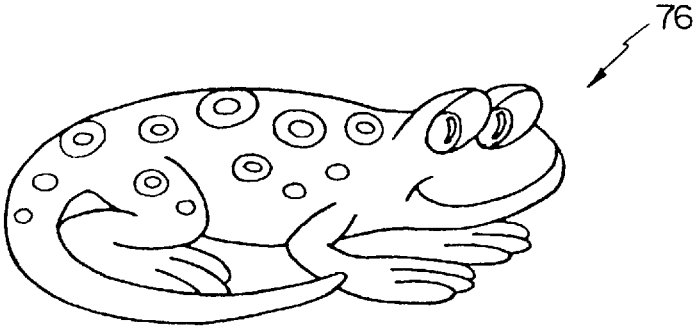
Figure 9:
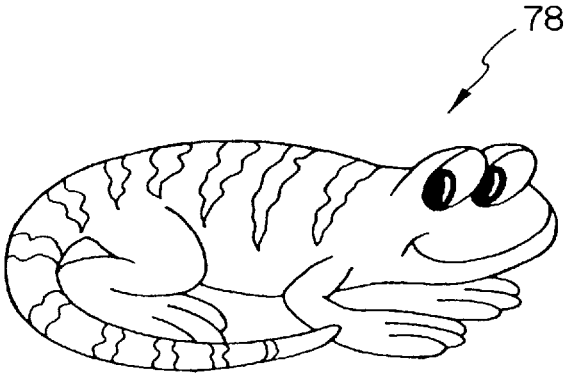

FIG. 3 shows a typical applique 40, one of a plurality of differently shaped and colored appliques depicting entities which belong to scene 24 (an "entity" according to the invention is any person, animal, or thing, whether natural or man-made, which is recognizable by the child). Applique 40 may be, for example, a three-dimensional "puffy", i.e., a flat-backed sticker having the outline shaped like the selected entity with a raised, soft body, contoured in the manner of a bas-relief to resemble the entity chosen. The appliques may be made, for example, of vinyl over polyurethane foam, heat sealed over an adhesively backed vinyl sheet. Alternatively to such a "puffy" sticker, flat appliques can be provided in less expensive kits.

Any means of attaching the applique to the surface of the decal is contemplated by the invention. An adhesive which will securely attach the applique to the decal while allowing it to be removable is preferable, for it allows the child to change the scene during its creation, possibly to add or modify a storyline. Other acceptable attachment means comprise smooth surfaces for both decal and applique which adhere together by static cling, or by forming a vacuum therebetween. Still alternatively, each surface may include coacting metallic and magnetic particles which will hold them together.

The entity depicted by applique 40 in FIG. 3 is a butterfly 42 which has brightly colored markings 44 on the wings 46 suggestive of real butterflies. It is within the purview of the invention either to render the chosen entity meticulously faithful to its natural counterpart or to portray the entity as a cartoon character. The markings 44 on the wings 46 of butterfly 42 could, for instance, be an accurate likeness of the markings of a Monarch butterfly. The name of the entity, e.g., Monarch Butterfly, can be imprinted on the applique at any convenient location. Accuracy of depiction adds an educational aspect to the invention, inasmuch as it teaches the child about the outside world in an unobtrusive and pleasing manner. Providing a caricature of a recognizable entity emphasizes the toy aspect of the training system, thereby increasing the play atmosphere. A smiling, friendly face 48 adds warmth to the animation, increasing its appeal to a child.

Applique 50 (FIG. 4) portrays a bird 52 with colorful markings 54 and a friendly face 56. The sticker shown is a caricature, but, as before, it could be a faithful rendition of a real bird, such as a robin, a cardinal, bullfinch, didapper, dabchick or other small grebe.

Applique 60 (FIG. 5) shows a squirrel 62. The entity can be portrayed such as to represent role models and/or illustrate desired traits. For instance, the squirrel's dress 64 and acorn 66 suggests the mother as feeder of the family and the virtues of thrift and preparedness as exemplified in the characteristic of squirrels to collect and store acorns for the winter.

The kit can be designed to teach nature, and as such scene 24 can be populated solely with wild animals. Returning to FIG. 1, the scene has been populated with animals; note the frog 11, turtle 13, salamander 15, squirrel 17, and bird 19.

Alternatively, the scene can be designed to guide the child to create his/her own comic strip scene by including appliques of cartoon-like animals. For example, a smiling snail 68 wearing hat 70 (FIG. 6) and a friendly turtle 72 with hat 74 (FIG. 7) can be drawn so that, when attached to pastoral scene 24, it is as if they are in conversation. For subsequent successful potty episodes, the child can have them joined by other selected characters, such as the sister and brother fraternal twin salamanders 76 and 78 of FIGS. 8 and 9.

Figure 10:
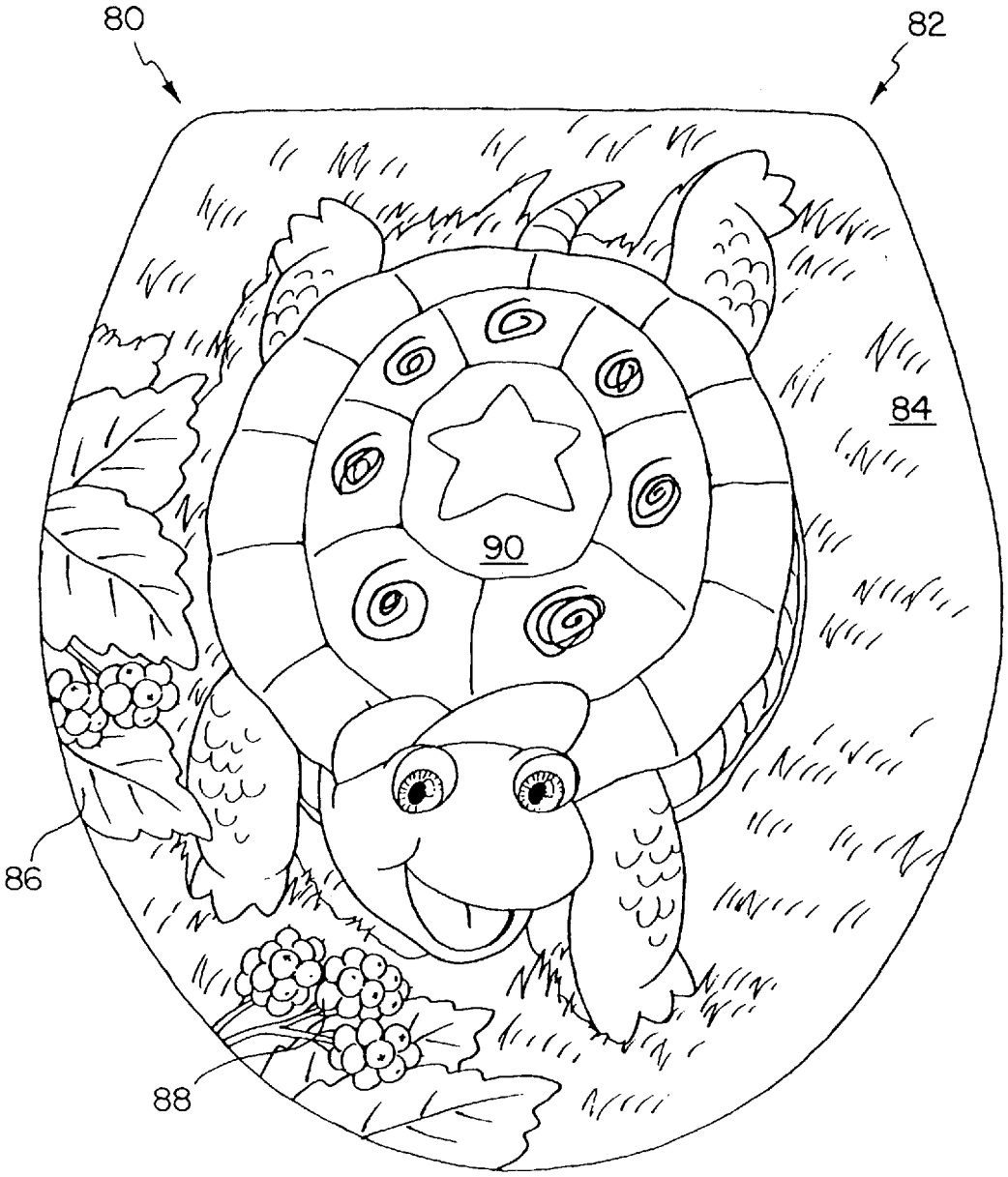
FIG. 10 is a top view of another decal with an applique thereon.

FIG. 10 illustrates a decal 80 with a different nature scene 82, e.g., a lawn 84 bordered by bushes 86 with cherries, grapes, or berries 88. A turtle 90 is located in the middle of scene 82, and the smaller appliques may be applied to the back of the turtle, for example.

The interest of the child can be maintained throughout the potty training period by providing other sets of entities, other woodland animals, trees, flowers, cats, dogs, cows, horses, wagons, cars, and/or people. Houses, barns, and fences can be added to create a village or farm. Pastoral scene 24 is only representative of the many different scenes which can be provided. Action settings, sports arenas, and household interiors, with suitably designed appliques, e.g., soldiers, baseball players, furniture, etc., can replace the disclosed scene, should the child become bored with the old scene, to restore the child's interest in continuing the potty training.

One can immediately see the unlimited opportunities afforded by the invention for stimulating the learning faculties of the child.

In use, decal 20 is attached to a flat surface of the toilet lid 16. It is preferable to attach decal 20 to the top 22 of lid 16, for this ensures that the lid will be closed, when the child is playing with the kit, thus placing the contents of toilet 10 out of reach of the child and minimizing the possibility of the child dropping one of the small stickers into bowl 12, probably followed by a quick retrieval thereof. Either or both broad surfaces, i.e., the top and/or bottom, of lid 16 can be used, however. If intended for the bottom of lid 16, an appropriate size for the background decal would be a circle, approx. nine inches in diameter.

The child is given an applique after each successful pottying episode to apply to the decal at a location of his/her choosing. As the child sees his/her own picture developing, it is natural that an increase in interest in playing with the kit will follow. And, since pottying is associated with a fun toy, potty training will be unobtrusively promoted in a pleasant way. Finally, since the kit is located on the toilet, the toilet will become a comfortable part of the child's life, rather than a stressful one.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the following Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

I claim as my invention:

1. A potty training kit comprising:

a toilet comprising a bowl, a seat, and a lid, said lid including a top and a bottom;

a decal depicting a scene, said decal including means for affixing said decal to said top of said lid; and a plurality of appliques, each of which represents an entity belonging to said scene and each of which includes means for attaching said each applique to said decal, whereby said decal being affixed to said top of said lid and a single applique being given to said child as a reward after each successful potty experience, said child will be induced by the desire of completing said scene by attaching all of said appliques to said decal that said child will be encouraged to effect frequent and successful potty experiences, thereby rendering said kit effective as a toilet training aid.

2. The training kit of claim 1 wherein said decal comprises a flat, planar sheet, having a scene imprinted on the top surface and a pressure-sensitive adhesive on the bottom surface.

3. The training kit of claim 2 wherein said decal is made of vinyl.

4. The training kit of claim 3 wherein said decal is of such a size and shape as to conform to the dimensions of the top of the lid.

5. The training kit of claim 4 wherein said decal scene is a background scene.

6. The training kit of claim 1 wherein each said applique is three-dimensional with a flat back and a raised, contoured soft body.

7. The training kit of claim 6 wherein each of said appliques are made of vinyl over polyurethane foam, the vinyl being heat sealed to an adhesively backed vinyl sheet.

8. The training kit of claim 1 wherein each said applique comprises a flat piece applique made of vinyl.

9. The training kit of claim 1 wherein said means for attaching said applique to said decal comprises said decal and said appliques being of such material as to statically cling to each other.

10. The training kit of claim 1 wherein said means for attaching said applique to said decal comprises a pressure sensitive adhesive.

11. A method of training a child to use a toilet in a predetermined manner wherein the toilet includes a toilet lid, comprising the steps of:

affixing a sheet depicting a scene to the top surface of the lid;

rewarding said child after use of the toilet in the predetermined manner by providing said child with at least one of a plurality of appliques adapted for attachment to said sheet, each said applique having a predetermined shape corresponding to a character associated with said scene; and allowing said child to attach said appliques to said sheet so that the child is induced to use the toilet in the predetermined manner in order to add characters to said scene.

* * * * *